US007641985B2

(12) United States Patent
Srinivasan

(10) Patent No.: US 7,641,985 B2
(45) Date of Patent: Jan. 5, 2010

(54) BORON FREE JOINT FOR SUPERALLOY COMPONENT

(75) Inventor: Vasudevan Srinivasan, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 604 days.

(21) Appl. No.: 10/873,046

(22) Filed: Jun. 21, 2004

(65) Prior Publication Data

US 2005/0281704 A1 Dec. 22, 2005

(51) Int. Cl.
*B32B 15/04* (2006.01)
*B22F 5/04* (2006.01)

(52) U.S. Cl. ..... 428/678; 75/255; 148/527; 148/528; 148/537; 428/548; 428/553; 428/555; 428/615; 428/655

(58) Field of Classification Search ..... None
See application file for complete search history.

(56) References Cited

U.S. PATENT DOCUMENTS 2,910,356 A * 10/1959 Grala et al. ..... 420/460
3,554,740 A * 1/1971 Williams et al. ..... 75/235
3,879,831 A * 4/1975 Rigney et al. ..... 415/173.4
3,887,363 A * 6/1975 Smashey et al. ..... 148/404
3,922,168 A * 11/1975 Restall et al. ..... 420/448
3,964,877 A * 6/1976 Bessen et al. ..... 75/246
3,993,454 A * 11/1976 Giggins et al. ..... 428/553
4,008,844 A 2/1977 Duvall et al.
4,059,217 A 11/1977 Woodward
4,096,615 A 6/1978 Cross
4,098,450 A 7/1978 Keller et al.
4,152,816 A 5/1979 Ewing et al.
4,270,256 A 6/1981 Ewing
4,381,944 A 5/1983 Smith, Jr. et al.
4,451,431 A * 5/1984 Naik ..... 420/588
4,493,451 A 1/1985 Clark et al.
4,615,864 A * 10/1986 Dardi et al. ..... 420/437
4,615,865 A * 10/1986 Duvall et al. ..... 420/588
4,676,843 A 6/1987 Nazmy
4,705,203 A 11/1987 McComas et al.
4,736,883 A 4/1988 Morgan et al.
4,743,514 A * 5/1988 Strangman et al. ..... 428/678
4,804,815 A 2/1989 Everett
4,830,934 A 5/1989 Ferrigno et al.

(Continued)

FOREIGN PATENT DOCUMENTS

JP 58-141355 * 8/1983 ..... 420/445
JP 58-153752 * 9/1983 ..... 420/445

OTHER PUBLICATIONS

ASM Materials Engineering Dictionary, ASM International, 1992, pp. 466-467.*

*Primary Examiner*—John P. Sheehan

(57) ABSTRACT

A boron-free and silicon-free bonding alloy (16) for joining with a superalloy base material (12, 14). The bonding alloy includes aluminum in a concentration that is higher than the concentration of aluminum in the base material in order to depress the melting temperature for the bonding alloy to facilitate liquid phase diffusion bonding without melting the base material. The concentration of aluminum in the bonding alloy may be at least twice that of the concentration of aluminum in the base material. For joining cobalt-based superalloy materials that do no contain aluminum, the concentration of aluminum in the bonding alloy may be at least 5 wt. %.

3 Claims, 1 Drawing Sheet

U.S. PATENT DOCUMENTS 5,086,968 A 2/1992 Fawley et al.
5,156,321 A 10/1992 Liburdi et al.
5,320,690 A 6/1994 Beltran et al.
5,437,737 A 8/1995 Draghi et al.
5,482,789 A * 1/1996 O'Hara et al. ..... 428/652
5,524,695 A 6/1996 Schwartz
5,549,767 A 8/1996 Pietruska et al.
5,806,751 A 9/1998 Schaefer et al.
5,836,075 A 11/1998 Fitzgerald et al.
5,956,845 A 9/1999 Arnold
5,972,289 A * 10/1999 Sikka et al. ..... 420/445
6,193,141 B1 2/2001 Burke et al.
6,195,864 B1 3/2001 Chesnes
6,264,761 B1 7/2001 Hasegawa et al.
6,280,857 B1 * 8/2001 Sommer et al. ..... 428/633
6,325,871 B1 12/2001 Burke et al.
6,331,217 B1 12/2001 Burke et al.
6,365,285 B1 4/2002 Chesnes
6,454,885 B1 9/2002 Chesnes
6,468,367 B1 * 10/2002 Mukira et al. ..... 148/428
6,471,791 B1 * 10/2002 Nazmy et al. ..... 148/429
6,508,000 B2 1/2003 Burke et al.
6,520,401 B1 2/2003 Miglietti
6,575,349 B2 6/2003 VanEsch
6,756,131 B2 * 6/2004 Oguma et al. ..... 428/632
6,919,042 B2 * 7/2005 Beers et al. ..... 420/441
2002/0157737 A1 * 10/2002 Chesnes et al. ..... 148/528
2003/0136811 A1 7/2003 Philip

* cited by examiner

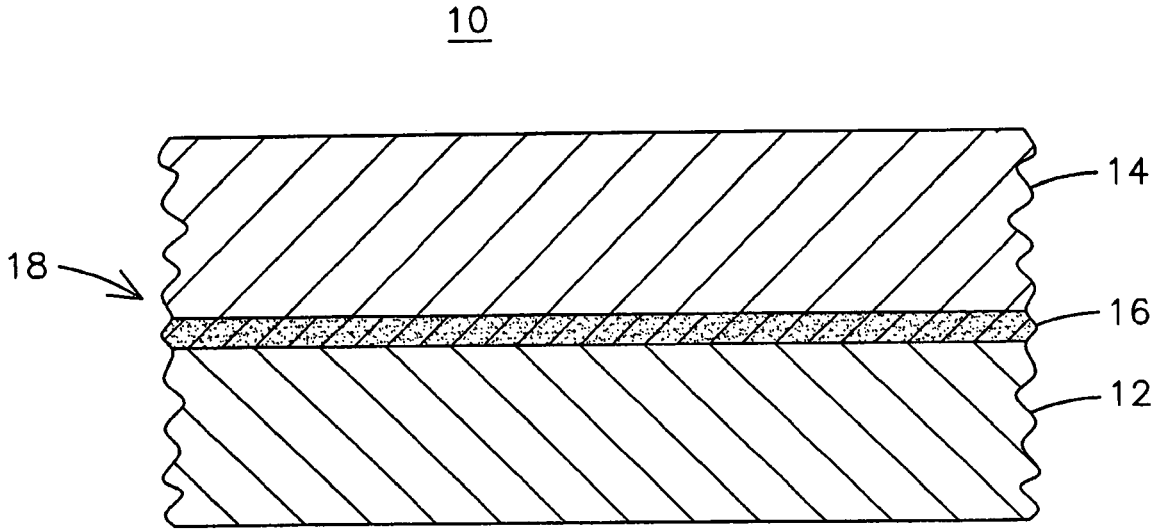
10
14
18
16
12

BORON FREE JOINT FOR SUPERALLOY COMPONENT

FIELD OF THE INVENTION

This application applies generally to the field of metallurgy, and more specifically to the manufacturing and repair of alloy articles, and in particular, to the manufacturing and repair of a superalloy component of a gas turbine engine.

BACKGROUND OF THE INVENTION

High temperature nickel-based and cobalt-based superalloys are well known. Examples of such materials include the alloys that are commercially available under the following designations and whose specifications are known in the art: U500; U520; U700; U720; IN 738; IN 718; IN 939; IN 718; MAR-M 002; CM 247; CMSX 4; PWA 1480; PWA 1486; ECY 768 and X45. Superalloy materials are commonly used in the manufacture of gas turbine engine components, including combustors, rotating blades and stationary vanes. During the operation of these components in the harsh operating environment of a gas turbine, various types of damage and deterioration of the components may occur. For example, the surface of a component may become cracked due to thermal cycling or thermo-mechanical fatigue or it may be eroded as a result of impacts with foreign objects and corrosive fluids. Furthermore, such components may require a materials joining process to close casting core-prints or to repair areas damaged during manufacturing operations even prior to entering service. Because the cost of gas turbine components made of cobalt-base and nickel-base superalloys is high, repair of a damaged or degraded component is preferred over replacement of the component.

Several repair and joining techniques have been developed for various applications of superalloy materials. Fusion welding of superalloy materials is known to be a difficult process to control due to the tendency of these materials to crack at the area of the weld deposit/joint. However, with careful pre-weld and post-weld stress relief, control of welding parameters, and selection of welding materials, repair welds can be performed successfully on superalloy components.

Brazing is also commonly used to join or to repair superalloy components. One limitation of brazing is that brazed joints are typically weaker than the base alloy, and so they may not be appropriate in all situations, such as repairs on the most highly stressed areas of the component.

Another process that has been used successfully for repair and material addition to superalloy components is known by several different names: diffusion bonding; diffusion brazing; Liberdi powder metallurgy (LPM); and liquid phase diffusion sintering. These names generally refer to a process wherein a powdered alloy (a "gluing alloy") is melted at a temperature that is less than the liquidous temperature of the component alloy and is allowed to solidify to become integral with the component. The powdered alloy typically includes particles of a high strength base alloy, for example the same alloy as is used to form the base component, along with particles of a braze alloy including a melting point depressant such as boron or silicon. The following United States patents describe such processes and are hereby fully incorporated by reference herein: U.S. Pat. Nos. 4,381,944; 4,493,451; 5,549,767; 4,676,843; 5,086,968; 5,156,321; 5,437,737; 6,365,285; and 6,454,885. The component and powder are subjected to a heat cycle, often called a brazing heat treatment, wherein the temperature is selected so that the braze alloy having the lower melting temperature will become liquid and will wet the surfaces of the higher melting temperature base alloy and component alloy. The component is held at this elevated temperature for a sufficient interval to promote liquid phase sintering. Liquid phase sintering is a process whereby adjacent particles in a powder mass are consolidated by diffusion through a liquid phase present between the particles. As the melting point depressant diffuses away from the braze area, the melting point of the remaining material will increase and the liquid material will solidify to form the desired braze joint. This process may be used to join two pieces, to repair a damaged area, or to add material to a component. Upon completion of this cycle, typical braze alloys will have formed undesirable large blocky or script-like brittle phases composed of chromium, titanium, and the family of refractory elements (e.g., tungsten, tantalum) combined with the melting point depressants. These brittle phases weaken the repaired component and decrease its ductility in the region of the repair. A further post-braze diffusion heat treatment may be applied at a somewhat lower temperature to break down the brittle borides, carbides and silicides into fine, discrete blocky phases and to further drive the melting point depressant away from the braze joint to more fully develop the desired material properties. Such a liquid phase diffusion bonding process is capable of forming a joint with material properties approximating but typically not as good as those of the base alloy. Welding is generally avoided proximate the braze joint because the embrittling effect of the residual melting point depressant may cause cracking during cool down from the high temperature required for welding.

Prior art nickel-based superalloy bonding materials typically contain very low amounts of aluminum in order to suppress eutectic gamma prime formation during re-solidification on the bond region, such as those described in U.S. Pat. No. 6,325,871 B1 as having no more than 5.5 wt. % aluminum. Prior art cobalt-based superalloy bonding materials typically contain no aluminum, such as those described in U.S. Pat. No. 5,320,690.

DESCRIPTION OF THE DRAWINGS

The sole FIGURE is a partial cross-sectional view of a joint formed in a superalloy component.

DETAILED DESCRIPTION OF THE INVENTION

The melting temperatures of various nickel-aluminum alloy compounds are known in the art. It is known that the compounds containing about 60-80 wt. % aluminum (40-20 wt. % nickel) have a melting temperature of about 1,000-800° C. The present inventor has noted the significance of the fact that such melting temperatures are significantly below the melting temperature of a typical nickel-based superalloy, which may be about 1,500° C. The present inventor has innovatively applied such materials in one embodiment of the present invention for joining of nickel-based superalloy components.

The FIGURE illustrates a component 10 of a gas turbine engine having a first superalloy substrate material 12 being joined to a second superalloy substrate material 14 by a brazing alloy 16 to form a joint 18. The superalloy substrates 12, 14 may be any nickel-based or cobalt-based superalloy material known in the art. The major elemental constituents in a superalloy material may include nickel, cobalt, chrome and aluminum. The brazing alloy 16 is a binary alloy including nickel and aluminum, with other elements added optionally. The brazing alloy 16 has a composition that provides an incipient melting temperature sufficiently below the melting temperature of the substrate materials 12, 14 so as to enable the materials to be joined without melting of the substrate materials 12, 14. While the embodiment of the FIGURE illustrates the joining together of two substrate materials, one skilled in the art will appreciate that the present invention may be used in other applications such as for adding material to a single substrate, for repairing cracks and other surface flaws in a substrate, etc.

The brazing alloy 16 has elemental constituents that exist in the materials 12, 14 being joined, or at least are non-detrimental to those materials, and yet at the same time the brazing alloy 16 has a lower melting temperature than the substrate materials 12, 14 by virtue of the selection and concentration of its elemental constituents. Aluminum is selected as a constituent of alloy 16 because it has a significantly lower melting temperature than the superalloy substrate materials. Nickel is selected as a constituent of the alloy 16 because it provides strength in the final joint 18. The deleterious use of boron, silicon or other melting point depressant material in greater than trace quantities is avoided. In one embodiment the braze material is $Al_3Ni$ is distributed in an aluminum matrix. The aluminum of braze material 16 rapidly diffuses into the superalloy substrate materials 12, 14, during the joining process and during any subsequent diffusion heat treatment or operating condition heat regiment, thus providing a joint that will exhibit properties approaching those of the substrate materials 12, 14. The braze material 16 tends to form gamma prime precipitates within the matrix of the substrate material. While no actual measurements have been made to date, the present inventor believes that the formation of gamma prime eutectics is eliminated or reduced so as to be innocuous as a result of the elimination of boron from the joint chemistry. The resulting microstructure and chemistry of the bond joint 18 will be within the range of design allowable values for the substrate material 12, 14 as the braze material is essentially distributed into the substrate. Alternatively, if the resulting bond joint 18 exhibits properties that are somewhat degraded when compared to the substrate material, the bond of the present invention may still be used advantageously in regions of a component that are not subjected to the highest levels of stress. Furthermore, braze joint region 18 may be formed as a single crystal material. Toward this end, it may be desired to reduce the volume of the braze material used to a value less than typical prior art processes. In one embodiment, braze material foil having a thickness of only 25-50 microns is used. Thinner foils may be used provided they can be handled conveniently. The absence of boron and silicon in the braze joint 18 makes it possible to perform a welding process that incorporates the joint region 18 without excessive concern about cracking.

In one embodiment, nickel-based superalloy articles formed of a superalloy material sold under the trademark MAR M 002 (wt. % composition of 5.5% Al, 10.0% Co, 9.0% Cr, 1.5% Hf, 2.5% Ta, 1.5% Ti, 10.0% W, 0.05% Zr, 0.015% B, balance Ni) available from The C-M Group of SPS Technologies, Inc. are joined using a boron-free compound having a wt. % composition of 21% Al, 10% Co, 5% Cr, 1% Ti, 0.5% Hf, 0.5% Zr, and balance Ni. At a joining temperature of 1,000° C., 70 wt. % of a powder or paste of this material in the form of tape will become liquid, thereby providing the necessary gluing effect. After brazing or joining the parts are diffusion-annealed in the range 1177 to 1232° C. (2150 to 2250° F.) for times up to 24 hours. Thereafter the parts go through the manufacturer recommended heat treatment to achieve required high temperature strength. Alternatively, a 50-50% mixture of powders of the base MAR M 002 alloy and a bonding alloy having a wt. % composition of 21% Al, 10% Co, 5% Cr, 1.0% Ti, 0.5% Hf and balance Ni may be used as the bonding material. In this mixture the bonding alloy will be 100% liquid at 1,000° C. The percentage of liquid phase at a particular temperature lower than the incipient melting temperature of the substrate base alloy may be achieved by proper selection of the joining compound composition, such as may be selected using commercially available software programs, such as the software licensed under the trademark JmatPro by Thermotech, Ltd., and the trademark CALPHAD available from the Calphad Group.

The present invention further envisions joining nickel-based superalloy materials with bonding alloys including or consisting essentially of the range of compositions of Table 1.

TABLE 1

| Element | Broad Range wt. % | Preferred Range wt. % |
|---|---|---|
| Ni | balance | balance |
| Al | 10-30 | 15-25 |
| Co | 0-25 | 2-15 |
| Cr | 0-25 | 5-15 |
| Ti | 0-3 | 0-2 |
| Hf | 0-2 | 0-1 |
| Zr | 0-2 | 0-1 |
| Ce | 0-2 | 0-1 |
| La | 0-2 | 0-1 |

For an embodiment where a cobalt-based superalloy is joined, the braze material 16 may still be selected to contain aluminum, even though aluminum is not typically a constituent of the substrate material 12, 14. In one embodiment, cobalt-based superalloy articles formed of a superalloy material sold under the trademark MAR M 509 (wt. % composition of 55.0% Co, 23.5% Cr, 3.5% Ta, 0.2% Ti, 7.0% W, 0.6% C, balance Ni) available from The C-M Group of SPS Technologies, Inc. are joined using a boron-free compound having a wt. % composition of 16% Al, 22% Ni, 10% Cr, 1% Ti, 0.5% Hf, 0.5% Zr, and balance Co. At a joining temperature of 1,000° C., 58 wt. % of a powder or paste of this material in the form of tape will become liquid, thereby providing the necessary gluing effect. After brazing or joining the parts are diffusin-annealed in the range 1177 to 1232° C. (2150 to 2250° F.) for times up to 24 hours. Thereafter the parts go through the manufacturer recommended heat treatment to achieve required high temperature strength. Alternatively, a 50-50% mixture of powders of the base MAR M 509 alloy and a bonding alloy having a wt. % composition of 22% Al, 16% Ni, 10% Cr, 1.0% Ti, 0.5% Hf, 0.5% Zr and balance Co may be used as the bonding material. In this mixture the bonding alloy will be 100% liquid at 1,000° C.

The present invention further envisions joining cobalt-based superalloy materials with bonding alloys including or consisting essentially of the range of compositions of Table 2.

TABLE 2

| Element | Broad Range wt. % | Preferred Range wt. % |
|---|---|---|
| Co | balance | balance |
| Al | 5-30 | 15-20 |
| Ni | 10-40 | 10-30 |
| Cr | 0-15 | 4-10 |
| Ti | 0-3 | 0-1 |
| Hf | 0-2 | 0-1 |
| Zr | 0-2 | 0-1 |
| Ce | 0-2 | 0-1 |
| La | 0-2 | 0-1 |

The constituents of the bonding materials are generally selected from only those materials that are contained in the substrate material in greater than trace amounts, plus aluminum and optionally one of the lanthanide series, such as Ce or La for example, in order to lower the melting temperature. The constituent materials specifically exclude boron and silicon above trace amounts. The weight percent concentration of aluminum in the bonding material is greater than the weight percent concentration of aluminum in the substrate material; and in alternate embodiments, the wt. % aluminum content in the boding material may be at least two, three, four or five times the wt. % aluminum content in the substrate material being bonded. For joining superalloy substrate materials containing aluminum in no more than a trace amount, at least 5 wt. % of aluminum may be included in the bonding alloy.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. A joint comprising a superalloy base material metallurgically joined with a bonding alloy, characterized in that the bonding alloy comprises 21 wt. % aluminum, 10 wt. % cobalt, 5 wt. % chrome, 1 wt. % titanium, 0.5 hafnium, and balance nickel, such that a melting point temperature of the bonding alloy is lower than a melting point temperature of the superalloy base material for forming the joint without melting the superalloy base material.

2. A superalloy article comprising:

a substrate material comprising 5.5 wt. % aluminum, 10.0 wt. % cobalt, 9.0 wt. % chrome, 1.5 wt. % hafnium, 2.5 wt. % Ta, 1.5 wt. % titanium, 10.0 wt. % tungsten, 0.015 wt. % zirconium, 0.0 15 % boron, and balance nickel; and a bonding material joined to the substrate material, the bonding material comprising 21 wt. % aluminum, 10 wt. % cobalt, 5 wt. % chrome, 1 wt. % titanium, 0.5 wt. % hafnium, 0.5 wt. % zirconium, and balance nickel.

3. The joint of claim 1, wherein the bonding alloy further comprises 0.5 wt. % zirconium.

* * * * *

UNITED STATES PATENT AND TRADEMARK OFFICE

CERTIFICATE OF CORRECTION

PATENT NO. : 7,641,985 B2
APPLICATION NO. : 10/873046
DATED : January 5, 2010
INVENTOR(S) : Vasudevan Srinivasan It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 856 days.

Signed and Sealed this

Sixteenth Day of November, 2010

David J. Kappos

David J. Kappos
*Director of the United States Patent and Trademark Office*